US005186984A

United States Patent [19]

Gabbert

[11] Patent Number: 5,186,984

[45] Date of Patent: Feb. 16, 1993

[54] SILVER COATINGS

[75] Inventor: James D. Gabbert, Des Peres, Mo.

[73] Assignee: Monsanto Company, St. Louis, Mo.

[21] Appl. No.: 545,439

[22] Filed: Jun. 28, 1990

[51] Int. Cl.[5] ..... C23C 26/00

[52] U.S. Cl. ..... 427/443.1; 427/304

[58] Field of Search ..... 427/443.1, 304

[56] References Cited

U.S. PATENT DOCUMENTS

| | | | |
|---|---|---|---|
| 2,327,723 | 7/1940 | Levaggi | 427/304 |
| 3,900,320 | 8/1975 | Rolker | 204/30 |
| 3,920,864 | 11/1975 | Greenberg et al. | 427/169 |
| 3,978,271 | 8/1976 | Greenberg | 428/433 |
| 3,993,845 | 11/1976 | Greenberg et al. | 428/433 |
| 4,128,671 | 12/1978 | Suggs | 427/304 |
| 4,144,361 | 3/1979 | Feldstein | 427/304 |

FOREIGN PATENT DOCUMENTS

| | | | |
|---|---|---|---|
| 367746 | 4/1983 | U.S.S.R. | 427/304 |

*Primary Examiner*—Shrive Beck
*Assistant Examiner*—Vi Duong Dang
*Attorney, Agent, or Firm*—Thomas E. Kelley; Richard H. Shear

[57] ABSTRACT

A cyanide-free, ammoniacal silver solution comprising a chelant, e.g. EDTA, and soluble copper, e.g. cupric nitrate, at a level of at least about 1 mole copper/mole silver provides silver replacement coatings on copper-coated articles. Silver coatings have a low surface electrical resistivity, e.g. as low as about 0.02 to 0.05 ohms/-square.

6 Claims, No Drawings

SILVER COATINGS

Disclosed herein are coatings of oxidation resistant silver and methods of providing such coatings on a variety of substrates, especially textile substrates.

BACKGROUND OF THE INVENTION

Although silver can be deposited electrolessly onto metallic substrates from cyanide solution, the cyanide can present a risk. Alternatively, Greenberg et al. in U.S. Pat. No. 3,993,845 disclose the deposition of silver onto copper film by the chemical replacement from cyanide-free solutions. The replacement is effected by using an ammoniacal silver solution containing a chelant such as ethylenediaminetetraacetic acid (EDTA) or a salt thereof. It has been found that silver coatings prepared by this method often exhibit less than desirable characteristics, e.g. the silver is dark and susceptible to oxidation. And, since the rate of silver deposition is retarded in proportion to the concentration of copper in the replacement solution as the silver replacement progresses, those skilled in the art have attempted to maintain a low copper concentration in the silver replacement solution.

SUMMARY OF THE INVENTION

I have discovered, contrary to the prior art admonitions against high levels of copper in the replacement solution, that when I add a substantial quantity of soluble copper to the replacement solution, e.g. more than about 1 mole of dissolved copper/mole dissolved silver, the resulting deposited silver is surprisingly brighter in appearance and has substantially lower surface resistivity and exhibits substantial oxidation resistance. I have further discovered from observation of electron micrographs that the surface of the silver appears to be more crystalline than silver surfaces deposited by more conventional methods. Moreover, the surface of the silver layer appears to contain about 5 weight percent copper while the bulk of the silver is substantially pure. Accordingly, one aspect of this invention is a method for providing a silver coating on copper comprising contacting said copper with an ammoniacal silver solution comprising a chelant and soluble copper salt at a level of at least about 1 mole copper/mole silver.

A preferred method for providing a silver coating comprises:

(a) coating a substrate with a film-forming aqueous solution comprising water soluble polymer and water soluble compound of a catalytic metal of Group 8 in the weight ratio of at least 3:1;

(b) drying said solution to form a catalytically inert film comprising said polymer and said metal;

(c) activating at least selective areas of said film to catalyze electroless deposition of metal;

(d) electrolessly depositing copper on said selective areas; and (e) contacting said copper with an ammoniacal silver solution comprising a chelant and soluble copper salt at a level of at least about 1 mole copper/mole silver.

The silver coatings of this invention can be advantageously applied to a variety of substrates, e.g. transparent substrates such a glass, polyester film and polycarbonate sheet, textile materials such as fiber, yarn non-woven fabric and woven fabric, and molded parts. A preferred aspect of this invention is metallized textiles having a silver surface applied by the method of this invention. Another aspect of this invention is oxidation resistant silver.

DETAILED DESCRIPTION OF PREFERRED EMBODIMENTS

This invention provides a method for providing a silver coating on copper-coated substrates by contacting said copper-coated substrates with a cyanide-free, ammoniacal silver solution comprising a chelant and soluble copper at a level of at least about 1 mole copper/mole silver. Preferred chelants comprise ethylenediamine tetraacetic acid (EDTA) or a salt thereof. It has been found that useful solutions contain chelant in about an equimolar basis of EDTA per mole of silver. Although any soluble silver salt can be used, e.g. silver nitrate or silver acetate, silver nitrate is preferred. The choice of copper salt is limited to salts of anions which are also soluble with silver, e.g. cupric nitrate or acetate, with cupric nitrate being preferred. The ammoniacal solutions are preferably prepared with concentrated aqueous ammonia (about 30 vol % ammonia). Although the amount of ammonia can vary, solutions containing about 15–30 moles ammonia per mole of silver have been found to be useful. Although not necessary it is often useful to provide surfactant in the silver replacement solution. A useful surfactant is octyl phenoxy polyoxyethylene, e.g. Triton X-100 available from Rohm & Haas Company. Thus a preferred silver replacement solution consists essentially of dissolved silver nitrate and on a molar basis per mole of silver: cupric nitrate at a level of at least about 1 mole cupric ion, EDTA chelant at a level of at least about 1 mole EDTA, aqueous ammonia at a level of at least about 15 moles ammonia, and surfactant.

Although the deposition of copper onto substrates is well known in the art, a preferred method is that disclosed by Vaughn in Ser. No. 07/454,565 commonly assigned, incorporated herein by reference, where metal is electrolessly deposited onto catalytic films comprising water soluble polymer and a Group 8 metal. More particularly, such method comprises (a) coating a substrate with a film-forming aqueous solution comprising water soluble polymer, e.g. polyvinylalcohol, cellulose such as hydroxypropyl methyl cellulose or polyoxethylene, and water soluble compound of a catalytic metal of Group 8, e.g. palladium acetate, in the weight ratio of at least 3:1;

(b) drying said solution, e.g. at room temperature, to form a catalytically inert film comprising said polymer and said metal;

(c) activating at least selective areas of said film, e.g. by exposing the surface to a fluid at a temperature in the range of 150° C. to 500° C., so that such areas will catalyze electroless deposition of metal; and (d) electrolessly depositing copper on said selective areas. Such copper coated substrates can be provided with a silver coating by employing the silver replacement method of this invention, i.e. by contacting the copper with a cyanide-free, ammoniacal, silver replacement solution containing a chelant and soluble copper at a level of at least about 1 mole copper per mole silver.

The method of this invention can be used to provide silver onto a variety of copper-coated substrates. Preferred substrates include textile materials, e.g. monofilament fiber, chopped fiber, yarn, thread, rovings, tow, woven fabric and non-woven fabric. Textile substrates can comprises polymeric material, e.g. polyester or nylon, or inorganic material, e.g. glass. The silver coating according to this invention exhibits surprisingly low surface electrical resistivity, e.g. less than 0.2 ohms/square, preferably less than 0.1 ohms/square, more preferably not greater than about 0.075 ohms/square, say about 0.05 ohms/square and even as low as about 0.02 ohms/square.

Thus a preferred silver-coated article according to this invention is a silver-coated textile material which is coated with silver by contacting a copper-coated textile with a cyanide-free, ammoniacal silver solution comprising a chelant and soluble copper at a level of at least about 1 mole copper/mole silver and which has a surface electrical resistivity of less than 0.1 ohms/square. Such textile material has a metal laminate coating consisting of an inner layer of copper and outer layer of bright, white silver. Analysis indicates that the silver coating is substantially pure but the silver surface may contain copper, e.g. up to about 5 weight percent copper.

The following examples serve to further illustrate aspects of this invention.

EXAMPLE 1

This example illustrates the preparation of copper coated substrate.

An aqueous catalyst solution was prepared to have the following composition: 0.4 wt % polyvinyl alcohol (125,000 MW, 88% hydrated), 0.21 wt % palladium acetate, 0.24 wt % potassium acetate, 5 vol % acetone and 0.25 vol % triethylamine. A woven, nylon filament ripstop fabric (1.0 ounce/square yard), washed in caustic and rinsed was immersed in the aqueous catalyst solution and squeezed dry, providing a 40% wet weight gain. The fabric was air dried at 35° C. for about 15 minutes, providing a dry, catalytically-inert coated fabric (about 1.0 ounces/square yard); i.e. the polymer/catalyst added essentially no perceptible change in weight to the fabric. The catalytically-inert fabric was activated by exposure to 180° C. air for about 15 minutes, then immersed for about 10 minutes in a commercial copper electroless deposition solution (Macudep 54 from MacDermid Company) maintained at 25° C. to provide a coating of electrolessly deposited copper (the copper coated fabric weighed 1.2 ounces/square yard).

COMPARATIVE EXAMPLE 2

This example illustrates the application of a silver coating onto copper by a prior art method.

A section of the copper coated fabric prepared in Example 1 was immersed for 1 minute in a silver replacement solution containing 2.5 g/l silver nitrate, 15 ml/l concentrated ammonium hydroxide and 0.1 g/l octylphenoxypolyoxyethylene surfactant (Triton X-100 from Rohm & Haas Company); solution analysis: 14.7 mM/l silver and 222 mM/l ammonia. The fabric was rinsed in water and air dried. The dry, silver-coated fabric exhibited a 1.1% weight gain due to addition of silver and exhibited a gray appearance and surface resistance of 0.1 ohms/square.

COMPARATIVE EXAMPLE 3

This example illustrates another application of a silver coating onto copper by a prior art method.

An EDTA-supplemented silver replacement solution was prepared by adding 4.5 g EDTA and 5 ml concentrated (30 vol %) aqueous ammonium hydroxide per liter of the silver replacement solution of Comparative Example 2. A section of the copper-coated fabric prepared in Example 1 was immersed for 1 minute in the EDTA-supplemented silver replacement solution, rinsed in water and air dried. The dry, silver-coated fabric exhibited a 5.3% weight gain due to addition of silver and exhibited a yellow appearance (but lighter than the gray silver color of Comparative Example 2) and surface resistance of 0.2 ohms/square.

EXAMPLES 4–6

These examples illustrate the preparation of silver coated articles according to this invention.

A copper-supplemented silver replacement solution was prepared by adding cupric nitrate (2.5 hydrate) in the amounts indicated in Table 1 to the EDTA-supplemented silver replacement solution of Comparative Example 3. A section of the copper-coated fabric prepared in Example 1 was immersed for 1 minute in the copper-supplemented silver replacement solution, rinsed in water and air dried. As indicated in Table 1, the dry, silver-coated fabric exhibited >7.5 % weight gain due to addition of silver and exhibited a light yellow to white appearance and surface resistance of as low as about 0.05 ohms/square.

TABLE 1

| Example | Copper in Silver Sol'n | Silver Weight Gain | Surface Resistivity | Surface Color |
|---|---|---|---|---|
| Comp 2 | 0 | 1.1% | 0.1 ohm/sq | dark |
| Comp 3 | 0 | 5.3 | 0.2 | yellow |
| 4 | 15.7 mM/l | 7.5 | 0.2 | white |
| 5 | 31.4 | 9.1 | 0.05 | white |
| 6 | 47.1 | — | 0.05 | white |

EXAMPLE 7

This example further illustrates the effect of increasing copper concentration in decreasing the rate of deposition of replacement silver and the surprisingly low surface resistance.

Silver replacement solution was prepared by diluting 4 g silver nitrate, 45 ml concentrated (about 30 vol. %) ammonium hydroxide, and 7.5 g EDTA acid to 1,500 g with deionized water and dividing the solution into 200 g aliquots (silver analysis: 1.65 g/l, corresponding to 15.3 mM/l). Supplemental copper (0.86 mM/ml cupric nitrate solution) was added to certain aliquots as indicated in Table 2. Pieces of copper-coated fabric prepared as in Example 1 were immersed for 1 minute in silver replacement solution.

TABLE 2

| Copper Concentration | Silver Plate Rate* | Surface Resistivity (ohms/square) |
|---|---|---|
| 0 | .39 | .024–.025 |
| 4.3 | .95 | .020–.024 |
| 8.6 | .71 | .020 |
| 17.2 | .44 | .002–.005 |
| 34.4 | .34 | .002–.005 |

*Plate Rate - microinches depth/min

EXAMPLE 8

This example illustrates the deposition of a silver coating on an 11 inch wide roll of copper-coated, nylon 66, woven, filament ripstop fabric. The fabric was scoured in a caustic solution, rinsed and coated with electrolessly deposited copper by treatment essentially in the manner of Example 1 except that the roll was treated in a continuous web process, i.e. by passing through an aqueous catalyst solution, air drying, heat activating, immersion in a copper bath, rinsing and drying. The copper coating was about 0.25 microns thick. The roll of copper-coated fabric was run through a silver replacement solution with an immersion time of about 2 minutes; the silver replacement solution maintained at pH 9.6–9.7 contained silver nitrate (at about 3.6–3.7 g/l silver), cupric nitrate (at about 2.4–2.5 g/l copper, i.e. about 1.1 moles copper/mole silver), EDTA (at about 1 mole DTA/mole silver) and ammonium hydroxide (at about 28 moles ammonia/mole silver). The copper-coated fabric was over coated with a layer bright silver about 0.25 microns thick, having an average surface electrical resistivity of about 0.076 ohms/square.

While specific embodiments of the invention have been described, it should be apparent to those skilled in the art that various modifications thereof can be made without departing from the true spirit and scope of the invention. Accordingly, it is intended that the following claims cover all such modifications within the full inventive concept.

What is claimed is:

1. A method for providing a silver coating on copper comprising contacting said copper with a cyanide-free, ammoniacal silver solution comprising a chelant and soluble copper at a level of at least about 1 mole copper/mole silver.

2. A method according to claim 1 wherein said chelant comprises ethylenediamine tetraacetic acid (EDTA) or a salt thereof.

3. A method according to claim 1 wherein said solution comprises silver nitrate, cupric nitrate, EDTA and aqueous ammonia.

4. A method according to claim 3 wherein said solution consists essentially of dissolved silver and on a molar basis per mole of silver: copper at a level of at least about 1 mole cupric ion, chelant at a level of at least about 1 mole EDTA, aqueous ammonia at a level of at least about 15 moles ammonia, and surfactant.

5. In a method for providing a silver coating comprising:

(a) coating a substrate with a film-forming aqueous solution comprising water soluble polymer and water soluble compound of a catalytic metal of Group 8 in the weight ratio of at least 3:1;

(b) drying said solution to form a catalytically inert film comprising said polymer and said metal;

(c) activating at least selective areas of said film to catalyze electroless deposition of metal;

(d) electrolessly depositing copper on said selective areas; and (e) contacting said copper with a silver replacement solution; the improvement comprising contacting said copper with a cyanide-free, ammoniacal silver replacement solution containing a chelant and soluble copper at a level of at least about 1 mole copper per mole silver.

6. A method according to claim 5 wherein said chelant is ethylenediamine tetraacetic acid or a salt thereof.

* * * * *